United States Patent [19]

Barnetche-Gonzalez

[11] Patent Number: 4,967,854

[45] Date of Patent: Nov. 6, 1990

[54] DOUBLE CONE CUTTING HEAD FOR A DRILL BIT

[76] Inventor: Eduardo Barnetche-Gonzalez, c/o Barnetche Tool Co., International, Calle California No. 112, Mexico City, 12, Mexico

[21] Appl. No.: 417,392

[22] Filed: Oct. 5, 1989

[51] Int. Cl.[5] ..... E21B 10/08; E21B 10/46

[52] U.S. Cl. ..... 175/353; 175/354; 175/374; 175/376

[58] Field of Search ..... 175/228, 331, 353, 354, 175/356, 365, 367, 374, 376, 377, 378

[56] References Cited

U.S. PATENT DOCUMENTS

| | | | |
|---|---|---|---|
| 1,152,151 | 8/1915 | Decker | 175/376 X |
| 1,195,208 | 8/1916 | Griffin | 175/365 X |
| 2,227,209 | 12/1940 | Zublin | 175/354 X |
| 2,336,335 | 12/1943 | Zublin | 175/378 |
| 2,463,932 | 3/1949 | Zublin | 175/353 |
| 2,528,300 | 10/1950 | Degner | 175/378 X |
| 2,911,196 | 11/1959 | Cameron et al. | 175/374 X |
| 3,361,481 | 1/1968 | Maddock | 175/374 X |
| 4,154,312 | 5/1979 | Barnetche | 175/353 X |

FOREIGN PATENT DOCUMENTS

| | | | |
|---|---|---|---|
| 2068040 | 8/1981 | United Kingdom | 175/354 |

*Primary Examiner*—Stephen J. Novosad
*Attorney, Agent, or Firm*—Armstrong, Nikaido, Marmelstein, Kubovcik & Murray

[57] ABSTRACT

The present invention is directed to a cutting head for use in a rotary drill bit in which the cutting head comprises a stem and a base integrally formed with the stem. The base has a first cutting surface defined by a frustrum of a cone or other shape and a second cutting surface defined a cone or other shape, wherein the first and second cutting surfaces are coaxial with the axis of the cutting head. The cutting head is adapted to be attached to a drill bit such that the axis of the cutting head is oriented at an angle with respect to the axis of the drill bit.

23 Claims, 7 Drawing Sheets

FIG. 10
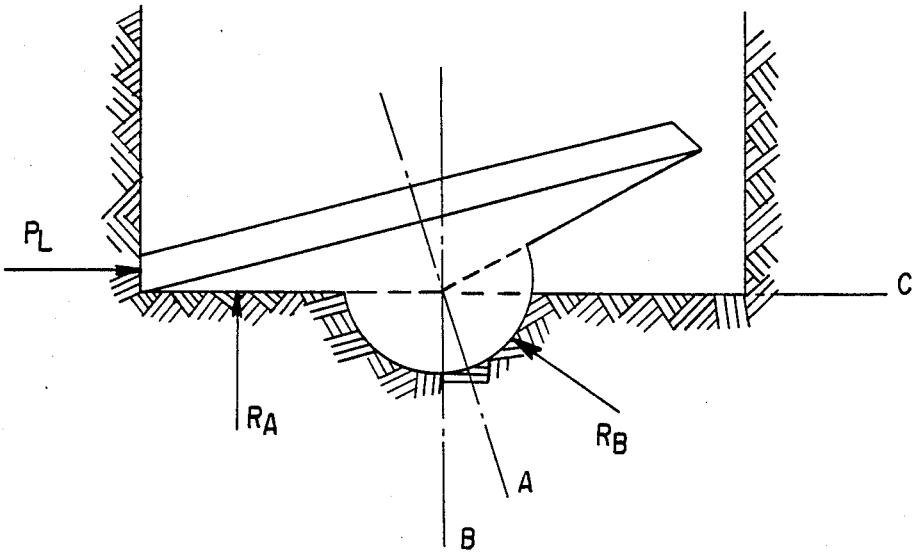
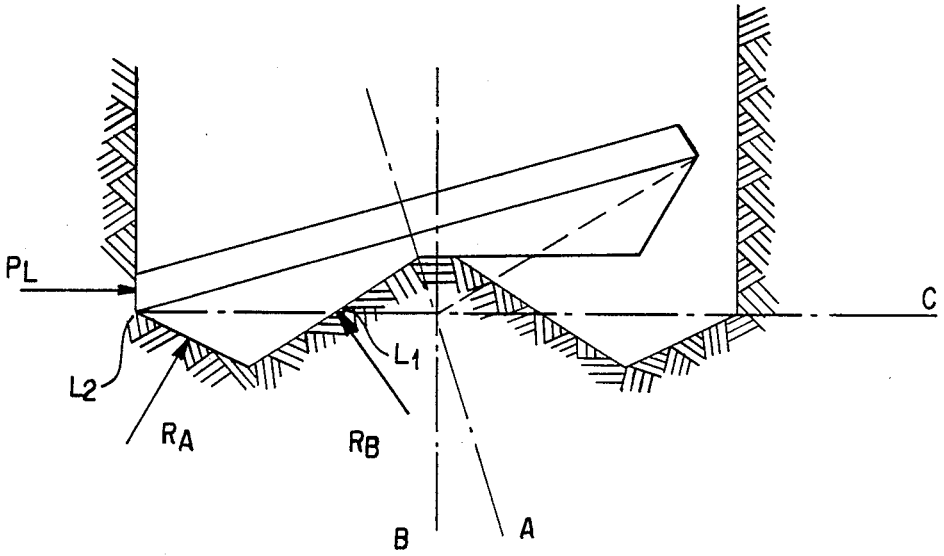
FIG. 11

DOUBLE CONE CUTTING HEAD FOR A DRILL BIT

BACKGROUND OF THE INVENTION

1. Field the Invention

The present invention is directed to a rotary drill bit for well drilling, and more particularly, to a rotary drill bit having a single cutting head with a double cutting surface profile.

2. Description of the Prior Art

Prior art drill bits for well drilling include bits which do not have any moveable parts, such as fish-tail bits, wing bits and diamond bits, and tricone bits which have three separate rotatable conical elements mounted on corresponding legs with bearings and seals which are individually built. In tricone bits the legs are then welded to a body to form a single unit. The drill bits having no moveable portions have the disadvantage of drilling very slowly and the tricone bits have the disadvantage of rapid wear at high speeds and difficulty in repair because the cones cannot be removed without cutting the welds. Furthermore, tricone bits are only practical in larger sizes with a diameter of greater than 6 inches because of the need for large bearings.

Another entirely different type of prior art drill bit is the single conical cutting head Barnetche bit such as shown in U.S. Pat. No. 4,154,312 issued May 15, 1979, of which the present invention is an improvement. U.S. Pat. No. 4,154,312 is incorporated herein by reference. In a bit such as that described in U.S. Pat. No. 4,154,312 it is necessary to include a stabilizer on the side of the drill bit for absorbing the lateral load generated by the bit cone which is spread over a large surface. One of the problems encountered in bits of this type, is the wear which occurs on the bit stabilizer due to the large lateral load.

SUMMARY OF THE INVENTION

It is the primary object of the present invention to provide a cutting head for a Barnetche bit in which the cutting head has at least two cutting surfaces which are oriented with respect to one another in order to reduce the lateral forces generated by the cutting head and thereby reduce the lateral loads on the drill bit stabilizer.

It is another object of the present invention to provide a cutting head for a Barnetche bit in which the cutting head has at least two cutting surfaces which produce rolling and scraping action on the bottom of a borehole.

It is a further object of the present invention to provide a cutting head for a Barnetche bit which includes two conical cutting surfaces, the conical surfaces being oriented in substantially opposite directions to thereby form a cutting surface which reduces the lateral force and thereby the lateral load on the drill bit stabilizer.

The present invention is directed to a cutting head for use in a rotary drill bit in which the cutting head comprises a stem and a base integrally formed with the stem. The base has a first cutting surface defined by a frustrum of a cone or other shape oriented in a first direction with respect to the axis of the cutting head and a second cutting surface formed by a cone or other shape oriented in a second direction with respect to the axis of the cutting head. The axes of the first and second cutting surfaces are coaxial with the axis of the cutting head. The cutting head is adapted to be attached to a drill bit such that the axis of the cutting head is positioned at an angle with respect to the axis of the drill bit.

BRIEF DESCRIPTION OF THE DRAWINGS

FIGS. 7–11 illustrate various embodiments of cutting heads of the present invention.

DETAILED DESCRIPTION OF THE PREFERRED EMBODIMENT

Figure 1:
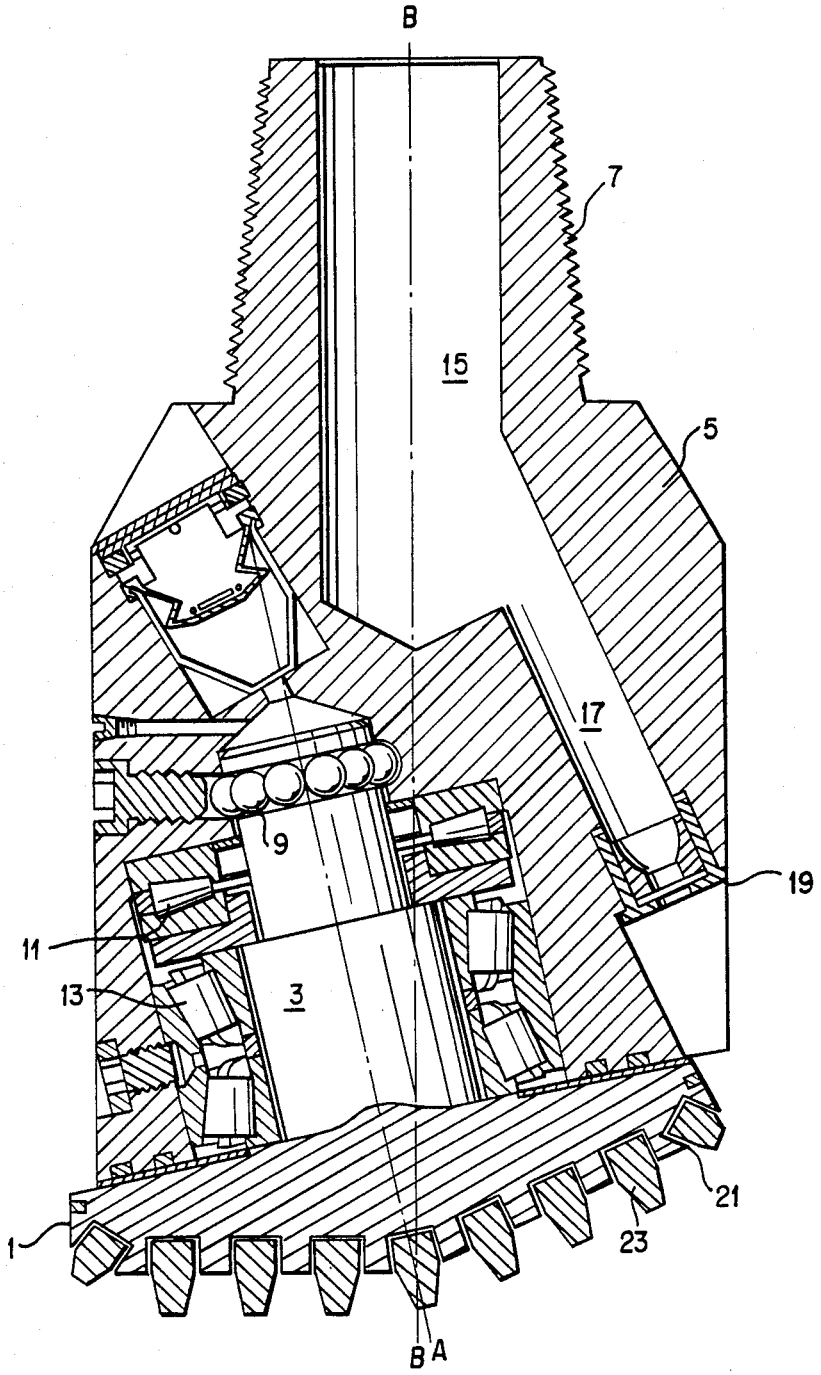
FIG. 1 is a sectional view of a prior art Barnetche bit.

FIG. 1 shows a cross-sectional view of a Barnetche bit such as that shown in U.S. Pat. No. 4,154,312. Conical cutting head 1 has a stem or shaft 3. The cutting head is oriented to rotate about axis A. The cutter or cutting head 1 is positioned within drill bit 5, the drill bit 5 having an axis B which is coaxial with the axis of a borehole. The drill bit 5 is attached to a drill string or column by means of threads 7 located at the top of the drill bit. The stem 3 of the cutting head is locked in place in the drill bits 5 through steel ball device 9. The loads which act on the cutting head and drill bit are absorbed or transmitted by means of roller bearings 11 and 13.

For disposal of the detritus formed during drilling, a drilling fluid flows through the drill string and into the drill bit through ducts 15 and 17 and then through nozzle 19.

The cutting head includes a plurality of holes or recesses 21 which receive inserts or cutting teeth 23 such as tungsten carbide teeth or stratapax, polycrystalline diamond cutter tips.

A single cone such as in the bit of FIG. 1, has an apex which coincides with the intersection of the two main axis A and B. Axis B is vertical and corresponds to the axis of the bit body and the axis of the hole; and axis A is the axis of the stem and the cutting head at its apex.

Figure 2:
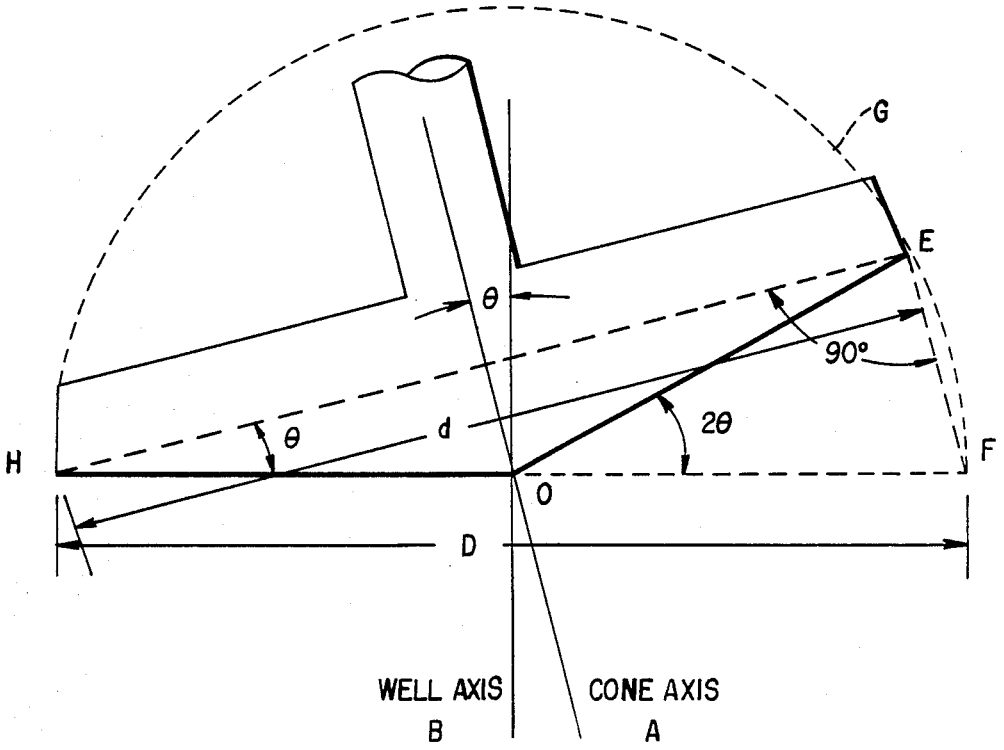
FIGS. 2–4 illustrate the geometric relationships of a single conical cutting head.
Figure 3:
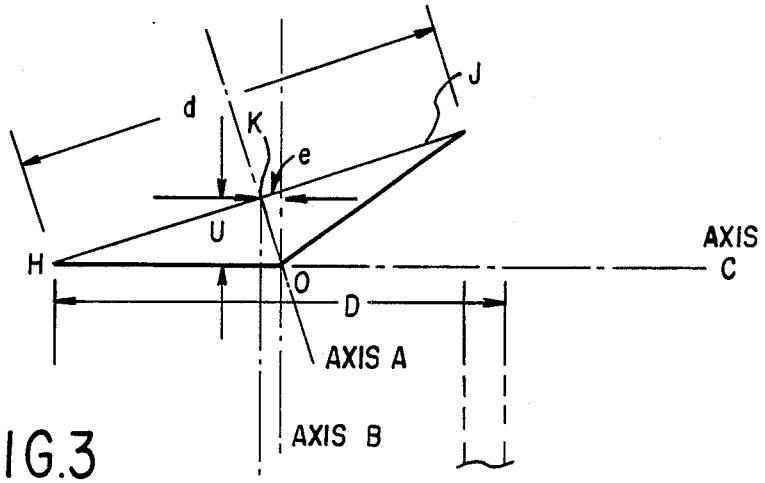
Figure 4:
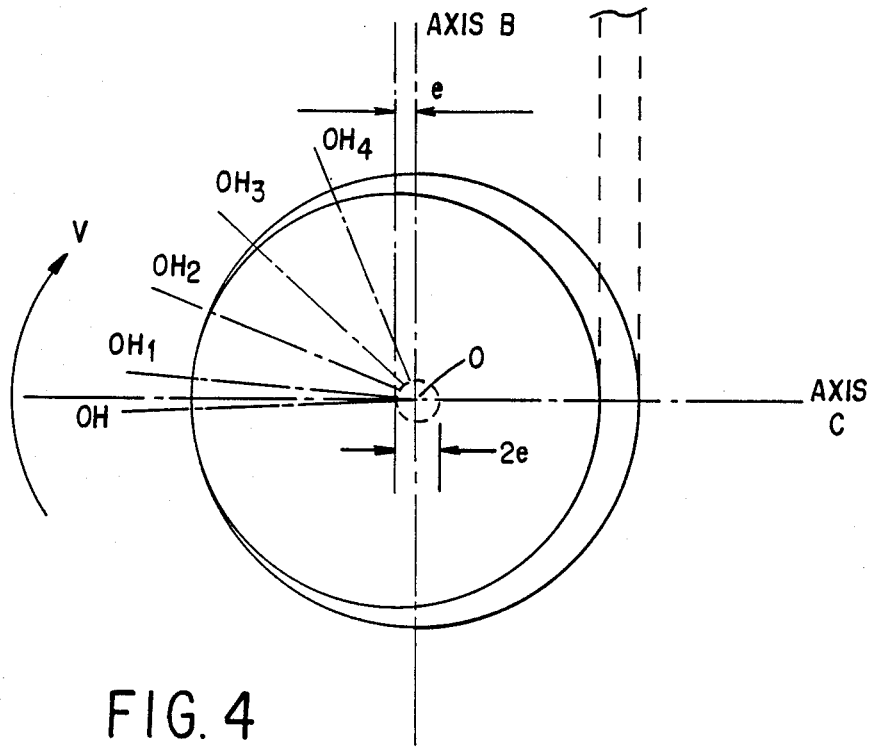

FIGS. 2–4 show the geometric relationships of the single cone bit 1 in which D is the diameter of the hole and d is the diameter of the single cone cutting head. The stem 27 rotates around the well axis B, the motion being produced by the rotation of the body transmitting the movement by means of the bearings as shown in FIG. 1. If there is no resistance due to friction or to a drilling torque imposed to the cutting head, its motion could be described as a "true rolling motion" successively over the generatrix of the cone with the apex of the cone being maintained at the center O. Of course in this ideal motion there is not any slippage or sliding, and no drilling torque. In this case, if the inclination of the stem is $\theta$ and its axis A is coplanar with the well axis B, the relation is as follows:

$$d = D \cos \theta$$

This is true because points E and F lie on circle G, and the angle at E is 90°. Because the angle $\theta$ is small, in the range of 12.5°, its cosine is close to one (1), so the effective diameter of the cone EH is slightly smaller than the diameter of the hole. Thus:

Circumference of the hole $=\pi D$

Circumference of the cutting head $=\pi D \cos\theta$

For each revolution of the cutting head the difference between the circumferences is:

$$\text{Diff.}=\pi D-\pi D\cos\theta$$

$$\text{Diff.}=\pi D(1-\cos\theta)$$

Taking the ratio of this difference to the circumference of the hole:

$$\frac{\text{Diff.}}{\text{Cir. of hole}}=\frac{\pi D(1-\cos\theta)}{\pi D}$$

$$\frac{\text{Diff.}}{\text{Cir. of hole}}=1-\cos\theta$$

for $\theta = 12.5°$ $$\frac{\text{Diff.}}{\text{Cir. of hole}}=1-\cos\theta=\frac{1}{42}$$

This shows that the cone rotates backward 1/42 of the circumference for each forward rotation of the bit body, producing a very peculiar drilling action. Also the above description implies that the cone mechanics is analogous to a very simple reduction gear mechanism, to produce great forces, useful in the drilling of rocks.

Another characteristic of the true rolling motion of the single cone is that the apex of the cone lies on the axis of the hole, and there is no friction and no drilling torque; or if there is friction and torque, they are compensated in such a way that the whole system is in equilibrium.

FIGS. 3 and 4 represent schematically the single cone in elevation and in plan when d is the diameter of the cone and D is the diameter of the hole. Rotating the cone around the axis B produces the true rolling action over consecutive generatrices $OH_1$, $OH_2$, $OH_3$, $OH_4$, etc. In the rolling action, the cone makes only line contact along the generatrix with the horizontal surface, without any sliding or scraping. Thus at the instant of contact there is zero relative velocity between the cutting surface and the surface of the rock. However, at every instant, the system passes from one generatrix to the next by the rotation of the cone about its own axis, which produces rolling (or instantaneous rotation) from one point of contact to the next.

As an example of the values involved in this instantaneous rotation, assume a hypothetical cone in which the intersection of its axis A with is base J, is located at a point K at a distance e from axis B and at a distance u from the horizontal axis C. If the cone is rotating at 500 r.p.m., the velocity of point K would be:

$$V=\frac{2\pi e N}{60}$$

assuming $e = \frac{1}{4}$ inch $$V=\frac{2N\times 0.25\times 500}{60}=13.09 \text{ inches/sec.}$$

Also, if u has a value of 3 inches, which is the distance from point K to the horizontal axis C, the velocity would be 13.09/3=4.36 inches/sec. for every inch away from the horizontal axis C.

The above described phenomenon provides a basis for improving the performance of the Barnetche bit by using different profiles and surfaces of revolution which can be designed not only to compensate for the lateral thrust but also to create the action of scraping with surfaces above and below the horizontal plane in which the instantaneous horizontal axis C is always present.

Figure 5:
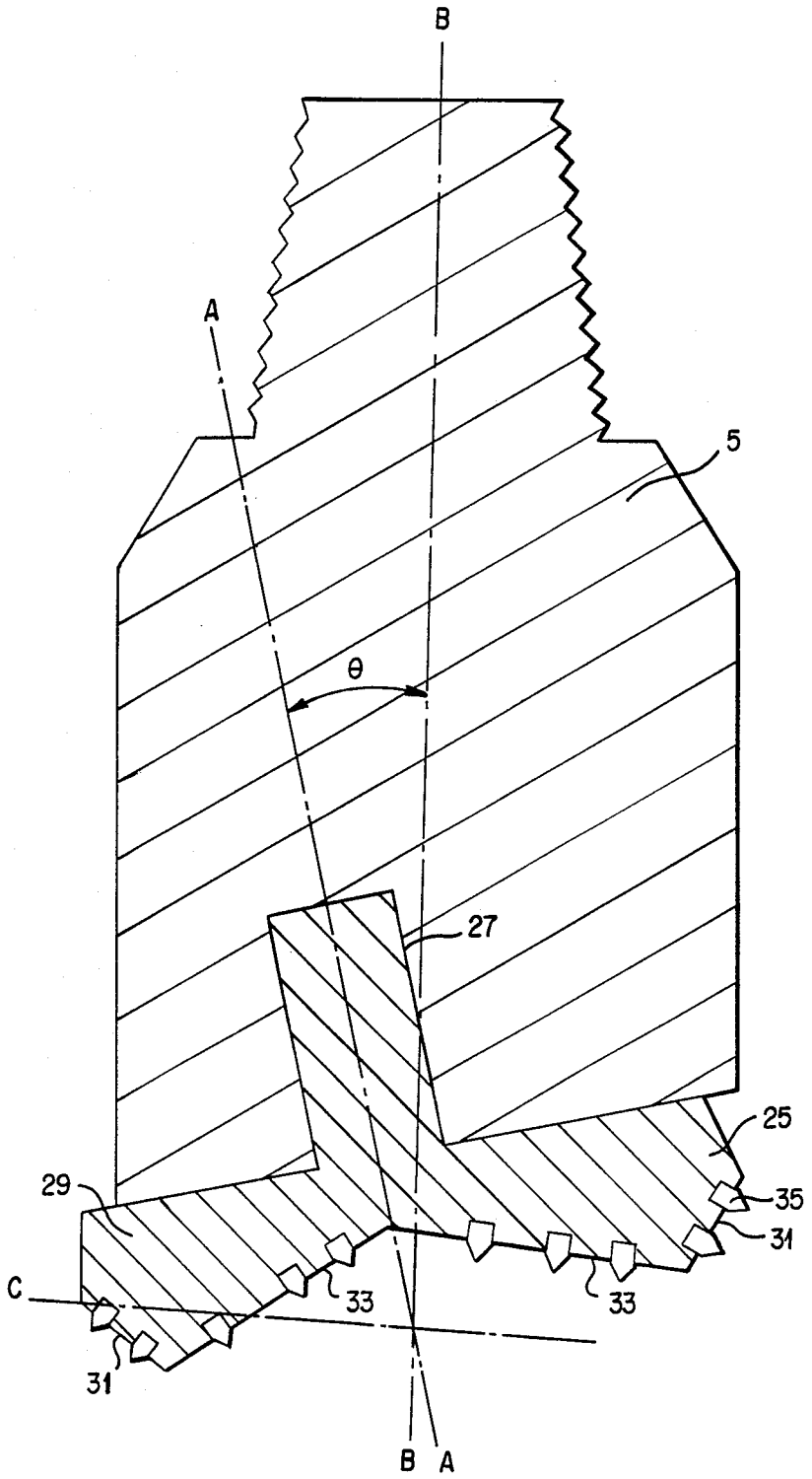
FIG. 5 is a cross-sectional view of a Barnetche bit including a conical cutting head of the present invention.

Referring to FIG. 5, the drill bit 5 is similar to drill bit 5 shown in FIG. 1, and although it is illustrated schematically, it includes bearings and a detritus removal system such as that used in the drill bit shown in FIG. 1.

Cutting head 25 of the present invention differs from the cutting head in FIG. 1 and includes a stem 27 and a base 29 integrally formed with stem 27. The base 29 includes a first cutting surface 31 formed by a frustrum of a cone, and a second cutting surface 33 which is conical. The axis A of the cutting head, the axis of the frustrum 31 and the axis of the cone 33 are all coaxial. The apex of the first cutting surface 31 is located in the opposite direction along the axis A from the apex of the second cutting surface 33. The axis of the cutting head and the axis of the drill bit are positioned at an angle $\theta$ with respect to one another.

As the drill bit turns, the cone rotates over a surface to be drilled, such as rock, causing the inserts 35 to impact and drill the rock. Due to the inclination of the cutting head as described above, the effective diameter of the cone is slightly smaller than the diameter of the hole. Therefore, during one revolution of cutting head, the cone rotates slightly less than one revolution of the body. This results in the cone precessing backwards slowly as the bit rotates.

Figure 6:
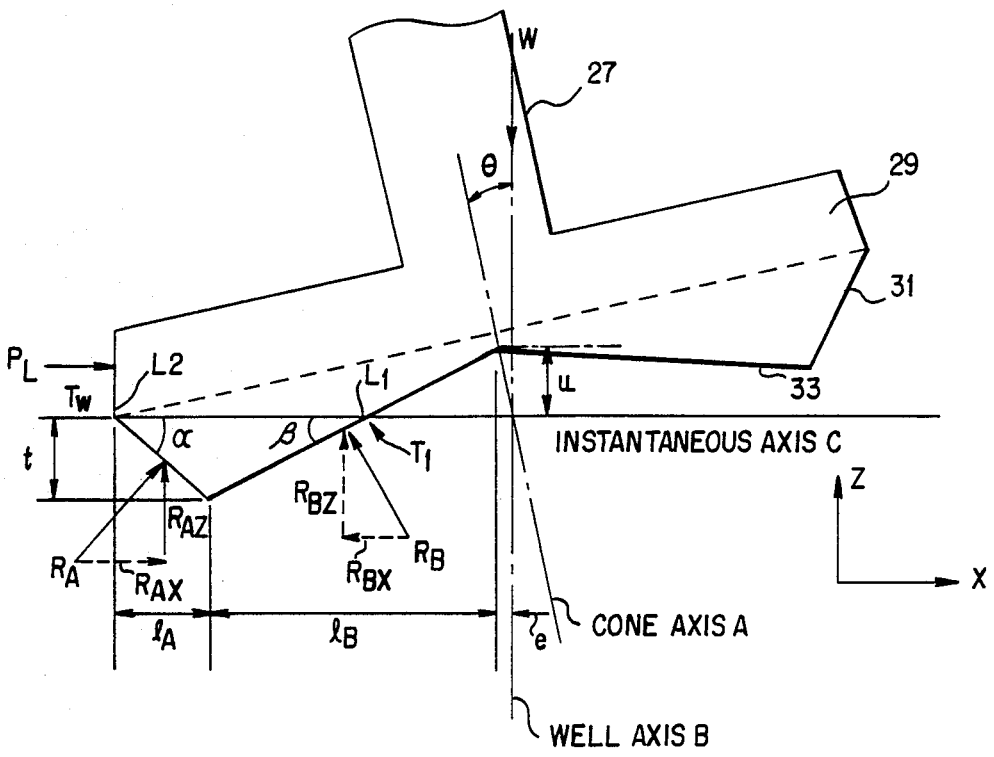
FIG. 6 is a schematic view of a conical cutting head of a present invention showing the various forces acting on the cutting head.
Figure 7:
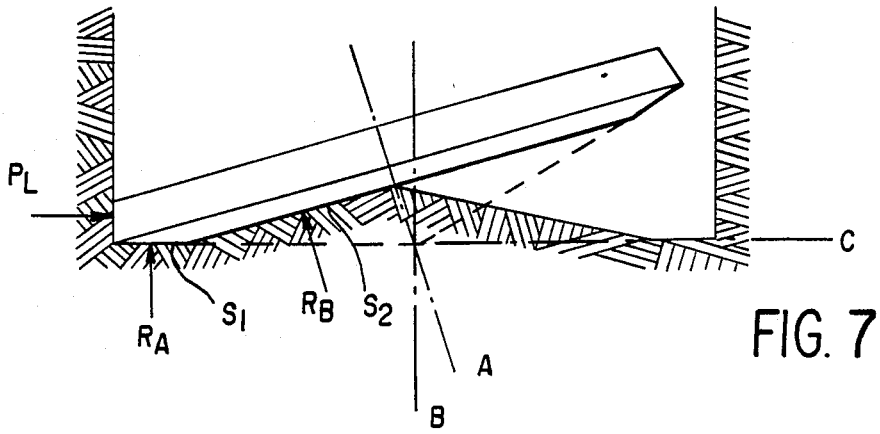

Referring to FIG. 6, which is a schematic diagram of a double conical head of the present invention, it can be seen that the reaction forces from the formations $R_A$ and $R_B$ give vertical components $R_{AZ}$ and $R_{BZ}$ acting on each face of the cones, the forces being proportional to the areas of the respective faces projected horizontally. In other words, the vertical forces are proportional to the areas defined by segments $l_A$ and $l_B$.

From the static equations:

$$\Sigma F_Z=R_{AZ}+R_{BZ}=W.$$

$$\Sigma F_X=R_{AX}+P_l=R_{BX}.$$

Defining:

$$Q_A=\frac{R_{AZ}}{W}$$

$$Q_B=\frac{R_{BZ}}{W}$$

$Q_A$ and $Q_B$ represent relations of proportion, or proportional quotients. Neglecting the small area under the center offset "e":

Then:

$$Q_A=\frac{(l_A+l_B)^2-l_B^2}{(l_A+l_B)^2}$$

-continued $$Q_B = \frac{l_B^2}{(l_A + l_B)^2}$$

In this form, assigning value to $Q_A$ and $Q_B$ can be obtained the corresponding $l_A$ and $l_B$. Further:

$$P_1 + R_{AX} - R_{BX} = 0$$

and $$R_{AZ} = R_A \cos \alpha$$

$$R_{BZ} = R_B \cos \beta$$

$$R_{AX} = R_A \sin \alpha$$

$$R_{BX} = R_B \sin \beta$$

Then:

$$\cos \alpha = \frac{l_A}{l_A^2 + t^2} \quad \cos \beta = \frac{l_B}{l_B^2 + (t + u)^2}$$

$$\sin \alpha = \frac{t}{l_A^2 + t^2} \quad \sin \beta = \frac{t}{l_B^2 + (t + u)^2}$$

From:

$$\Sigma F_Z$$

$$R_A = Q_{AW} \frac{l_A^2 + t^2}{l_A}$$

$$R_B = Q_{BW} \frac{l_B^2 + t^2}{l_B}$$

Using this in $\Sigma F_X$, equation:

$$\frac{P_1}{W} = \frac{Q_B (t + U)}{l_B} - \frac{Q_A t}{l_A}$$

With this equation, the value of $P_1$ can be calculated for different values of e and t, selecting previously determined values of $Q_A$ and $Q_B$, because:

$$Q_A + Q_B = 1.$$

With this set of equations, calculations can be made for a group of parameters chosen as geometric variables such as, t, e, u, $Q_A$, d and $\theta$ and calculate the lateral forces $P_1/W$. t and u are the distances from the axis C to the apexes of the conical cutting surfaces as shown in FIG. 6. For obtaining an optimum set of these geometric variables, the identification of satisfactory combinations can be assumed which are capable of accomplishing a low value of $P_1/W$, for instance in order of 0.1, or any other value needed for certain particular application and circumstances. A positive value of $P_1/W$ indicates that the cutting head will be pressing and rolling against the wall of the hole.

The above-described embodiment compensates and controls the lateral forces encountered in a conical bit and also provides a means to produce scraping action along the contact surface of the cutting head above and below the horizontal axis primarily at the central part of the cutter. Furthermore, it avoids the tendency of tracking which takes place when true rolling occurs and inserts hit the sam location in successive turns.

The proper equilibrium of forces and the design of the two faces of the cutting head, which is not necessarily conical, is determined in accordance with the required combination of crushing and scraping action; studying carefully the performance of the crushing and scraping elements (carbide inserts, stratapax inserts, milled teeth) with movement which results from the combination of the three axis of rotation which are present all of the time. Again, the three axis of rotation are:

AXIS A - Rotation of the cutting head around its proper shaft forming the angle $\theta$.

AXIS B - Rotation of the body around the center line of the hole.

AXIS C - Instantaneous horizontal axis of rotation formed by the line from the intersection of the two Axis A and B, being perpendicular to Axis B.

Axis C is very important, and can exist physically as the generatrix of a single conical surface with the vertex at the intersection of Axis A and Axis B. In this case, the rotation around Axis B produces a true rolling motion of the cone.

As seen in FIG. 6, the axis C exists in the major part of its length, from the lower perimeter of the cutter, as in the special profile of the double cone, in which only two circles, $T_l$ and $T_w$, intersect exactly with the instantaneous horizontal axis C. The profile shown is exaggerated to make apparent the different surfaces and angles to consider in the calculations of the parameters. The intersections or contacts $T_l$ and $T_w$ provide the traction through the rolling motion, to give the sliding motion to all the points of the two faces of the cones which are spaced from the axis, thereby producing the scraping action desired, especially at the center of the cutting head.

The scraping action uses part of the energy provided for drilling through rock or other formation, and takes a large part of the power needed, through the torque applied to the drill bit. Therefore, if the scraping is overemphasized, the traction or gripping of the formation derived from the surfaces with true rolling motion, may not be enough to overpower the resistance offered by the scraping surfaces. In this case, the resulting movement will be inhibited thus losing efficiency and the ability to drill.

The double cone profile shown in FIG. 6 is only one of many different profiles which can be designed to produce drilling tools for a number of applications, such as reamers, hole openers, very soft formation bits, etc.

FIGS. 7 to 11 show some embodiments of different profiles in which performance can be predicted to a certain extent by the method outlined above, such as the reaction $P_1$ against the bore-hole, which should always be positive, the surfaces contributing to the effective traction by true rolling on the surface in which the instantaneous horizontal axis C is rotating, and also the surfaces and volumes that have to be disintegrated by scraping and crushing.

Figure 8:
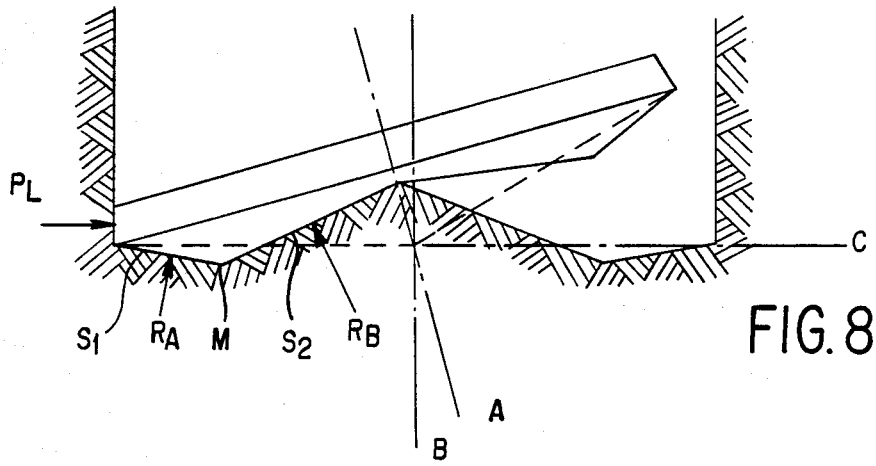

The profile of FIG. 8 provides an area on the true rolling surface $S_1$ of about 40% of the total area of the cutting head and a scraping surface $S_2$ of about 60% of the area of the cutting head which compensates for the lateral thrust producing a positive reaction $P_1$, as well as moderate action of scraping ensuring that tracking will be eliminated.

The weight applied to this drill bit should be selected for transmitting enough power to drill at high rotating speed and low torque, with good stabilization of the bit.

In the profile of the FIG. 8, $S_1$ is more than 50%, almost 60% of the total area of the cutting head and rotates with very little scraping. $S_2$, the remaining 40%, is in the central part of the cutting head. With this type of profile, good positive reaction can be expected to compensate for the lateral thrust as well as providing a moderate combination of crushing and scraping with a better penetration rate, and even better stabilization than the profile of FIG. 7. This is a result of the furrow effect created by the circular junction of the two conical surfaces, indicated at M in FIG. 8.

Figure 9:
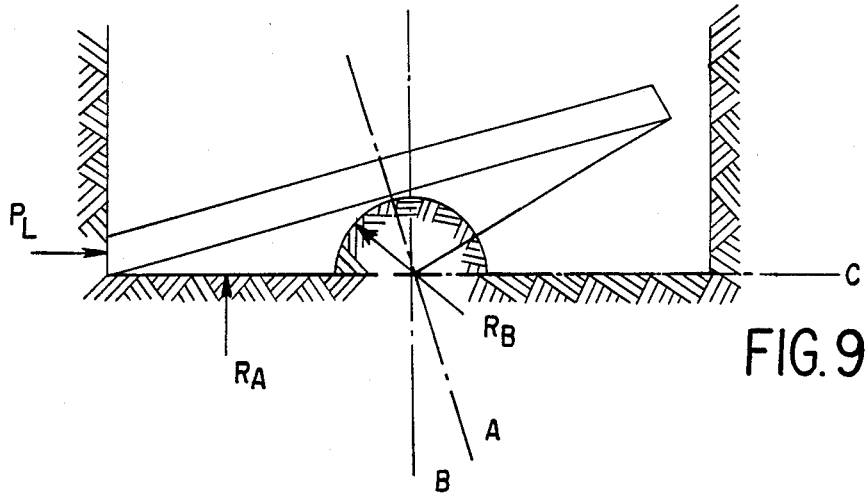

FIGS. 9 and 10 show two alternatives to combine spherical surfaces with conical or flat surfaces. The main characteristic of these cutting heads is that with a spherical surface it is possible to obtain pure scraping action, and with a cone having a surface aligned with axis C and an apex coinciding with the center of the sphere, pure rolling motion is obtained which results in crushing. With the two profiles of this type it is also possible to get full compensation of the lateral thrust.

Finally, the profile of the FIG. 11, which corresponds to theoretical FIG. 6, is an embodiment in which obtaining good drilling action is very difficult because there is not enough surface in which the rolling motion can be originated and maintained. It should be noted that rolling takes place only on two circular paths $L_1$ and $L_2$, the remaining cutting surface is scraping. Obviously, the surfaces and volumes that have to disintegrated by scraping are very large, and the surfaces above and below the plane of rotation of the axis C are opposing each other. In this embodiment, if there is enough torque available, the cutter will be dragged almost as a solid object.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A cutting head for use in a rotary drill for cutting the bottom of a borehole, said cutting head comprising:

(a) a stem means for attaching said cutting head to a drill bit; and (b) a base means integrally formed with said stem means, said base means when viewed in a vertical cross-section having a first cutting surface means oriented in a first direction with respect to the axis of said cutting head and second cutting surface means oriented in a second direction with respect to the axis of said cutting head, said first and second cutting surface means being coaxial with the axis of said cutting head wherein at least one of said first and second cutting surface means scrapes and crushes the bottom of the borehole.

2. A cutting head as set forth in claim 1, wherein the length of said first cutting surface means is less than the length of said second cutting surface means.

3. A cutting head as set forth in claim 1, wherein said first cutting surface means is frustrum of a cone and wherein said second cutting surface means is a cone.

4. A cutting head as set forth in claim 1, wherein said first cutting surface means is a frustrum of a cone and wherein said second cutting surface means is a portion of a sphere.

5. A cutting head as set forth in any one of claims 1 to 3, wherein said first cutting surface means intersects said base means, and a portion of said second cutting surface means extends from a point below the projection of the intersection of the first cutting surface means and base means in a direction perpendicular to the axis of a rotary drill to a point above the projection of the intersection.

6. A rotary drill apparats comprising:

(a) a drill bit means adapted for attachment to a drill string;

(b) a cutting head mounted in said drill bit means for cutting the bottom of a borehole, said cutting head including a stem means for attaching said cutting head to said drill bit and a base means integrally formed with said stem means, said base means when viewed in vertical cross-section having a first cutting surface means oriented in a first direction with respect to the axis of said cutting head and second cutting surface means oriented in a second direction with respect to the axis of said cutting head, said first and second cutting surface means being coaxial with the axis of said cutting head; and (d) wherein the axis of said cutting head is at an angle with respect to the axis of said drill bit means such that at least one of said first and second cutting surface means scrapes and crushes the bottom of the borehole.

7. A rotary drill apparatus as set forth in claim 6, wherein said drill bit includes stabilizer means.

8. A rotary drill apparatus as set forth in claim 6, wherein said apparatus has three axis of rotation comprising a first axis corresponding to the axis of said drill bit, a second axis corresponding to the axis of said cutting head, and a third axis corresponding to a line perpendicular to the first axis and extending from the intersection of the first and second axis wherein at least a portion of said first cutting surface means lies along said third axis.

9. A rotary drill apparatus as set forth in claim 8, wherein a portion of said second cutting surface means extends from a point below said third axis to a point above said third axis.

10. A rotary drill apparatus as set forth in any one of claims 6–9, wherein said first cutting surface means is a frustrum of a cone and wherein said second cutting surface means is a cone.

11. A rotary drill apparatus as set forth in claim 6, wherein said first and second cutting surface means include a plurality of recesses formed therein and a plurality of cutting inserts fixed in said recesses, wherein upon rotation of said drill apparatus in a borehole, said cutting inserts scrape and crush the material at the bottom of the borehole.

12. A cutting head for use in a rotary drill bit for cutting the bottom of a borehole, said cutting head comprising:

(a) a stem means;

(b) a base means integrally formed with said stem means, said base means including first partial conical cutting portion having an apex positioned at a first point along the axis of said stem means and a second conical cutting portion having an apex positioned at a second point along the axis of said stem means; and (c) wherein when viewed in a vertical cross-section, the axis of said stem means is at an angle with respect to the axis of the drill bit when said cutting head is mounted in the drill bit.

13. A cutting head as set forth in claim 12, wherein said first conical cutting portion is oriented such that when said first conical cutting portion contacts the bottom of a borehole, said first conical cutting portion is oriented perpendicular to the axis of the drill bit.

14. A cutting head as set forth in claim 12, wherein the length of said first partial conical cutting portion is less than the length of said second conical cutting portion.

15. A cutting head as set forth in any one of claims 12 or 14, wherein said first partial conical cutting portion intersects said base means and a portion of said second conical cutting portion extends from a point below the projection of the intersection of the first partial conical cutting portion and the base means in a direction perpendicular to the axis of the drill bit to a point above the projection of the intersection.

16. A cutting head for use in a rotary drill bit for cutting the bottom of a borehole, said cutting head comprising:

(a) a stem means;

(b) a base means integrally formed with said stem means, said base means including a partial conical cutting portion having an apex positioned along the axis of said stem means and a partial spherical cutting portion having a center positioned along the axis of said stem means; and (c) wherein when viewed in a vertical cross-section, the axis of said stem means is at an angle with respect to the axis of the drill bit when the cutting head is mounted in the drill bit.

17. A cutting head as set forth in claim 16, wherein said conical cutting portion is oriented such that when said conical portion contacts the bottom of a borehole, said conical cutting portion is oriented perpendicular to the axis of the drill bit.

18. A cutting head for use in a rotary drill bit, said cutting head comprising:

(a) a stem means;

(b) a base means integrally formed with said stem means, said base means having a first cutting means with an axis coaxial with the axis of said stem means and a second cutting means having an axis coaxial with the axis of said stem means; and (c) wherein when viewed sin a vertical cross-section, the axis of the said stem means is at an angle with respect to the axis of the drill bit when said cutting head is mounted in the drill bit and wherein at least one of said first and second cutting means scrapes and crushes the bottom of the borehole.

19. A cutting head as set forth in claim 18, wherein said first cutting surface is oriented such that when said first cutting surface contacts the bottom of a borehole, said first cutting surface is oriented perpendicular to the axis of the drill bit.

20. A cutting head as set forth in any one of claims 1–4, wherein both said first and second cutting surface means scrape and crush the bottom of the borehole.

21. A rotary drill apparatus as set forth in claims 7 or 11, wherein both said first and second cutting surface means scrape and crush the bottom of the borehole.

22. A rotary drill apparats as set forth in claim 10, wherein both said first and second cutting surface means scrape and crush the bottom of the borehole.

23. A cutting head as set forth in claim 18 or 19, wherein both said first and second cutting means scrape and crush the bottom of the borehole.

* * * * *